US009016393B2

(12) United States Patent
Sundholm et al.

(10) Patent No.: US 9,016,393 B2
(45) Date of Patent: Apr. 28, 2015

(54) SPRAYING HEAD, SPRAYING APPARATUS AND METHOD FOR FIRE EXTINGUISHING

(75) Inventors: Göran Sundholm, Tuusula (FI); Harry Metzger, Kerava (FI); Richard Eggleton, Vantaa (FI)

(73) Assignee: Marioff Corporation Oy (FI)

( * ) Notice: Subject to any disclaimer, the term of this patent is extended or adjusted under 35 U.S.C. 154(b) by 519 days.

(21) Appl. No.: 12/438,982

(22) PCT Filed: Sep. 25, 2007

(86) PCT No.: PCT/FI2007/050509

§ 371 (c)(1),
(2), (4) Date: Feb. 26, 2009

(87) PCT Pub. No.: WO2008/037846

PCT Pub. Date: Apr. 3, 2008

(65) Prior Publication Data

US 2009/0260837 A1 Oct. 22, 2009

(30) Foreign Application Priority Data

Sep. 26, 2006 (FI) ..... 20060853

(51) Int. Cl.

| | |
|---|---|
| ***A62C 37/08*** | (2006.01) |
| ***A62C 35/00*** | (2006.01) |
| ***A62C 31/05*** | (2006.01) |

(Continued)

(52) U.S. Cl.

CPC ..... *A62C 31/05* (2013.01); *A62C 35/62* (2013.01); *A62C 37/11* (2013.01); *B05B 15/001* (2013.01)

(58) Field of Classification Search

CPC ..... A62C 37/11; A62C 37/12; A62C 37/14; A62C 37/16; A62C 35/62; A62C 31/05

USPC ..... 169/37–42, 47, 61, 19, 17; 239/548, 239/554

See application file for complete search history.

(56) References Cited

U.S. PATENT DOCUMENTS 3,726,344 A * 4/1973 Rothman et al. ..... 169/37
4,553,602 A * 11/1985 Pieczykolan ..... 169/19

(Continued)

FOREIGN PATENT DOCUMENTS

JP 2004-275260 10/2004
WO 92/15370 9/1992

(Continued)

OTHER PUBLICATIONS

English abstract of JP 2004-275260 dated Oct. 7, 2004.

*Primary Examiner* — Len Tran
*Assistant Examiner* — Alexander Valvis
(74) *Attorney, Agent, or Firm* — Cantor Colburn LLP

(57) ABSTRACT

A spraying head, especially a spraying head intended for fire extinguishing, which comprises a frame part, an inlet for extinguishing medium and at least two nozzles. At least one first nozzle (9) is arranged in a spraying head part (2), for which first nozzle (9) the medium passage from the inlet of the spraying head is always open and that at least one second nozzle (4) is arranged in a sprinkler part (1) which comprises a triggering means (5), whereby the passage of medium from the inlet to at least one second nozzle (4) is closed when the triggering means (5) is non-activated, and that the passage of medium for at least one second nozzle (4) is open when the triggering means (5) is activated. The invention also relates to a method.

20 Claims, 3 Drawing Sheets

(51) Int. Cl.

| | |
|---|---|
| ***A62C 35/62*** | (2006.01) |
| ***A62C 37/11*** | (2006.01) |
| *B05B 15/00* | (2006.01) |

(56) References Cited

U.S. PATENT DOCUMENTS

| | | | | | |
|---|---|---|---|---|---|
| 5,513,708 | A | * | 5/1996 | Sundholm | 169/37 |
| 5,533,576 | A | * | 7/1996 | Mears | 169/90 |
| 5,573,065 | A | * | 11/1996 | Sundholm | 169/37 |
| 5,655,608 | A | * | 8/1997 | Sundholm | 169/90 |
| 5,720,351 | A | * | 2/1998 | Beukema et al. | 169/61 |
| 5,794,705 | A | * | 8/1998 | Kim et al. | 169/61 |
| 5,810,090 | A | * | 9/1998 | Sundholm | 169/46 |
| 5,845,714 | A | * | 12/1998 | Sundholm | 169/46 |
| 5,944,113 | A | * | 8/1999 | Sundholm | 169/37 |
| 5,947,207 | A | * | 9/1999 | Conforti et al. | 169/47 |
| 6,024,174 | A | * | 2/2000 | Pierce | 169/37 |
| 6,230,815 | B1 | * | 5/2001 | Sundholm | 169/37 |
| 6,296,062 | B1 | * | 10/2001 | Sundholm | 169/37 |
| 6,318,474 | B1 | * | 11/2001 | Sundholm | 169/37 |
| 6,345,670 | B1 | * | 2/2002 | Sundholm | 169/37 |
| 6,347,669 | B1 | * | 2/2002 | Sundholm | 169/37 |
| 6,454,017 | B1 | * | 9/2002 | Fischer et al. | 169/37 |
| 6,732,808 | B1 | * | 5/2004 | Sprakel | 169/17 |
| 6,976,544 | B2 | * | 12/2005 | Sundholm | 169/42 |
| 7,104,335 | B2 | * | 9/2006 | Shim | 169/37 |
| 7,878,419 | B2 | * | 2/2011 | Waddelow | 239/104 |
| 2006/0278410 | A1 | * | 12/2006 | Reilly et al. | 169/37 |

FOREIGN PATENT DOCUMENTS

| | | |
|---|---|---|
| WO | 96/01666 | 1/1996 |
| WO | 02/102462 | 12/2002 |

* cited by examiner

SPRAYING HEAD, SPRAYING APPARATUS AND METHOD FOR FIRE EXTINGUISHING

BACKGROUND OF INVENTION

The invention relates to a spraying head according to the preamble of claim 1, especially to a spraying head intended for fire extinguishing, which comprises a frame part, an inlet for extinguishing medium and at least two nozzles.

The invention also relates to a method for fire extinguishing according to the preamble of claim 10.

The invention also relates to a spraying apparatus according to claim 19.

In fire extinguishing technique, it is advantageous that a fire to be extinguished is detected in time. Then, the volume of extinguishing medium required for extinguishing the fire is small compared with a situation in which the fire has been able to become large. Furthermore, it is advantageous if the largest volume of extinguishing medium can be directed at the fire site itself or its immediate vicinity.

Sprinklers are known in fire extinguishing technique in connection with extinguishing systems which sprinklers comprise a triggering means after the activation (triggering) of which, e.g. from the effect of heat, a passage for extinguishing medium is opened to sprinkler nozzles. When the sprinkler is non-active, the triggering element has not triggered, the passage to the nozzles stays closed and the sprinkler does not spray extinguishing medium. On the other hand, also open spraying heads are known in connection with extinguishing systems which do not comprise a triggering means, but they spray extinguishing medium immediately after the passage of extinguishing medium to the inlet of the nozzle head is open.

In an open nozzle system (so-called "Deluge" system), extinguishing medium is conveyed to the feed pipe of the spraying head when a signal of a fire has been received from a fire detector. The spraying heads of the system in question are open spraying heads which start to spray extinguishing medium immediately when it is conveyed to them along a medium pipe. In the system, open spraying heads spray extinguishing medium for the whole area of the system or, in a system comprising several protection areas, to a certain subarea. Open nozzle systems are typically dimensioned to confine or extinguish sizeable fires, whereby the volume of extinguishing medium to be sprayed can also be rather large and many times extinguishing medium is conveyed to wrong areas from the viewpoint of protection. With conventional fire-extinguishing systems using large volumes of extinguishing medium, the disadvantage is emphasised, but also, with extinguishing systems based on water mist using considerably smaller volume of water, the excess spraying of extinguishing medium can be harmful, especially on sites where there are electronic devices or on sites having high hygiene requirements.

In fire extinguishing arrangements utilising sole sprinklers, closed when non-active, extinguishing medium is exclusively sprayed by activated sprinklers. Then, extinguishing output can be directed better, exactly at the fire site. However, the sprinkler is not activated until the fire has become quite large, whereby the required local volume of water is also great.

Also so-called mixed systems are known in which there are separate open spraying heads and separate sprinkler heads closed when non-activated in a certain area, e.g. arranged alternately into connection with an extinguishing medium pipe. Then, open nozzles produce an adequate volume of water for controlling relatively small fires, but if the fire has become large before the system is activated or if the fire develops very fast, the sprinkler nozzles start to trigger from the effect of heat at the fire site. The arrangement in question can be awkward from the viewpoint of installation, because the spraying heads are different from each other.

The object of this invention is to achieve a totally new arrangement by means of which fire extinguishing can be taken on already at such an early stage that the used volume of water will remain minimal, but which also has a capacity to control a larger fire, if required.

BRIEF DESCRIPTION OF INVENTION

The invention is based on an idea according to which a sprinkler head provided with a triggering means and an open spraying head are combined into one spraying head. According to the idea of the invention, through the open spray nozzles of each spraying head of the system is sprayed after the system has activated, at an early stage, quickly little extinguishing medium in a large area and, at a second stage, more extinguishing medium only through those spray nozzles the triggering means of which has activated and opened a passage to the spray nozzles.

The spraying head according to the invention is mainly characterised by that at least one first nozzle is arranged in a spraying head part, for which first nozzle the medium passage from the inlet of the spraying head is always open and that at least one second nozzle is arranged in a sprinkler part which comprises a triggering means, whereby the passage of medium from the inlet to at least one second nozzle is closed when the triggering means is non-activated, and that the passage of medium for at least one second nozzle is open when the triggering means is activated.

The spraying head according to the invention is further characterised by what is stated in claims 2-9.

The method according to the invention is mainly characterised by that, in the method, at the first stage, extinguishing medium is sprayed by at least one first nozzle of at least one nozzle head of the activated site and, at the second stage, additionally by at least one second nozzle activated nozzle-head-specifically, opened due to the triggering of the triggering means.

In addition, the method according to the invention is characterised by what is stated in claims 11-18.

The spraying apparatus according to the invention is mainly characterised by what is stated in claims 19-20.

The arrangement according to the invention has numerous significant advantages. The arrangement enables combining the advantages of an open spraying head and a sprinkler. By combining the spraying head and the sprinkler head to one unit, on one hand is provided a compact, easily modifiable spraying head the characteristics of which can be easily varied for the requirements of different applications. By using sprinkler parts different of their characteristics and, on the other hand, by using open spraying head parts of different characteristics, a group of different combinations of the spraying head and the sprinkler is obtained. Simultaneously is provided a spraying head which, after the system has activated, starts to spray extinguishing medium at the first stage from open nozzles and at the second stage, when heat in the vicinity of the triggering means of the sprinkler part of the spraying head has exceeded over a predetermined value, starts to spray also with the nozzles of the sprinkler part. By means of a spraying head according to the invention, the quick spraying of medium is thus obtained at the first stage. With certain characteristics of the spraying head and medium feeding, especially when spraying extinguishing medium mist, it is possible to provide an extremely good loading which is enough as such to extinguish starting fires. If the system is activated too late or if the fire develops very quickly, at the second stage after the sprinkler has activated is obtained an extremely good extinguishing output as the larger volume of extinguishing medium to be sprayed is directed straight at the fire site. The arrangement according to the invention can also be utilised in arrangements in which the first stage spraying is used e.g. for cooling and/or moistening air and only the second stage spraying for possible fire extinguishing. This arrangement thus gives a possibility to combine a moistening apparatus and a fire-extinguishing apparatus in a completely novel way. The arrangement also enables combining other applications, e.g., on explosible sites, the first stage spraying can be used from time to time as a preventive measure for preventing an explosion.

The spraying head is well applicable in arrangements in which one wishes to avoid using large volumes of water, such as in the fire protection of sites containing electronics or having high hygiene requirements.

By arranging a protective means, which is in a protective position in front of at least one nozzle of the spraying head and mechanically protects the nozzle and possibly also the triggering element when the spraying head is in a non-active position, into connection with the spraying head, an easily cleansable spraying head is obtained. The spraying heads provided with the protective element in question can be used in places where e.g. the surrounding conditions require protecting the spraying head. On the other hand, they are suitable for sites having high hygiene requirements.

In this specification, a sprinkler means a spraying head part which is provided with a triggering means, whereby, when non-active, the passage of medium between the inlet and the nozzle is closed and, when active, the passage of medium between the inlet and the nozzle is open.

BRIEF DESCRIPTION OF FIGURES

Next, the invention will be described in detail by means of an example with reference to the accompanying drawing in which.

DETAILED DESCRIPTION OF INVENTION

Figure 3:
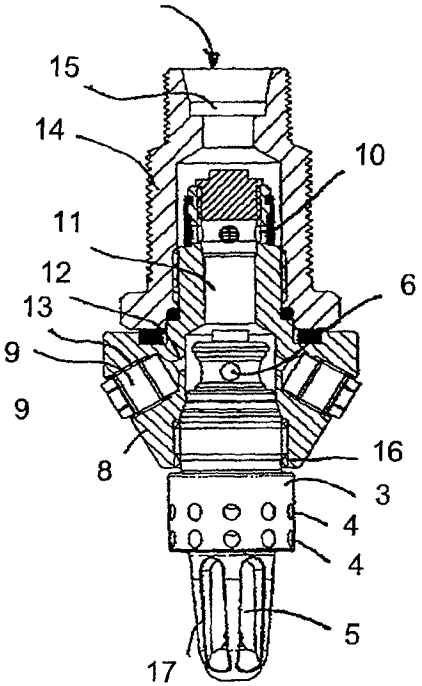
FIG. 3 shows a partly cut spraying head according to an advantageous embodiment of the invention.
Figure 1:
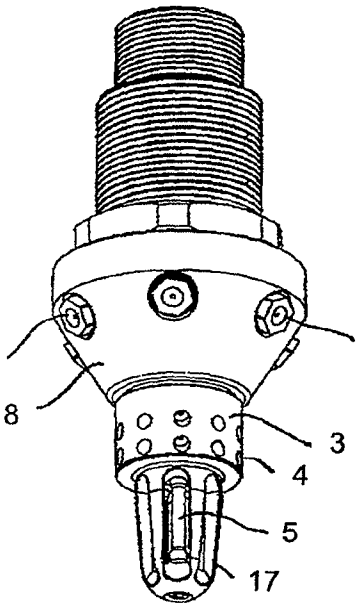
FIG. 1 shows a spraying head according to an advantageous embodiment of the invention.
Figure 2:
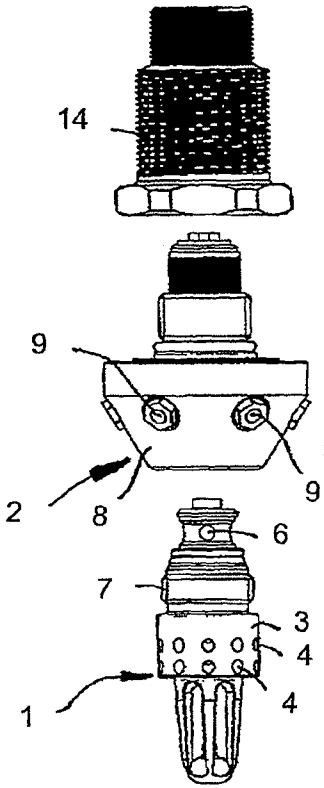
FIG. 2 shows separately the main parts of a spraying head according to an advantageous embodiment of the invention.

FIG. 1 shows an assembled spraying head according to an advantageous embodiment of the invention. FIG. 2, for its part, shows the main parts separated from each other of a spraying head according to an advantageous embodiment of the invention. In the embodiments of the figures, the spraying head comprises a sprinkler part 1, a spraying head part 2 and a spraying head holder 14.

The sprinkler part 1 comprises a sprinkler frame 3 and a triggering means 5 which is arranged into connection with the sprinkler frame by means of a holder 17. Several nozzles 4 are arranged in the spraying frame. When the triggering means 5 is in its place, a passage of medium from an inlet 6 of the sprinkler to at least one nozzle 4 of the sprinkler is closed. In the embodiment of the figure, the sprinkler comprises several nozzles 4. The type of the sprinkler part 1 can be similar to the one described e.g. in specification WO 01/45799, especially in FIG. 7-9 and in the description, but also other types of sprinkler parts can be applied in the invention.

The spraying head part 2 comprises a spraying head frame 8. The spraying head frame 8 comprises an inlet 10 and a passage of liquid 11, 12 from the inlet 10 to at least one nozzle 9. The nozzles 9 are in the embodiment according to the figure separate nozzles arranged in a bore by a screw connection. In the spraying head frame 8, there is a bore 11 in which there is a fastening point to the sprinkler frame 3. The fastening point is in relation to the inlet 10 at the opposite end of the spraying head frame 8. In the bore 11 are arranged threads 16 and in the sprinkler frame 3 counter threads 7. In the embodiment according to the figure, the threads 16 are internal threads and the counter threads 7 of the sprinkler head are external threads, respectively.

The spraying head according to the invention functions typically as follows. The spraying head is connected by the holder 14 to an extinguishing medium network which is typically at least at the point of the spraying head in the non-active mode a so-called dry pipe advantageously a so-called Deluge system. Then, by means of a detector, such as a fire, heat or smoke detector, in the system is controlled known per se a valve which, controlled by a signal coming from the detector, allows extinguishing medium into the piping and thus also from an inlet 15 of the spraying head via the medium passage 10, 11, 12 to the nozzles 9 of the spraying head frame 8. The nozzles 9 start to spray extinguishing medium.

The triggering means 5 of the sprinkler head 1 being in place, extinguishing medium cannot access the nozzles 4 of the sprinkler head. Not until the temperature set for the triggering means 5 in the vicinity of the sprinkler is reached and the ampoule or equivalent functioning as the triggering means 5 is broken, the medium passage opens from the inlet 6 of the sprinkler to the nozzles 4. Then, the combined spraying head sprays in addition to the nozzles 9 also with nozzles 4. Then, it is possible to obtain with the spraying head a maximum extinguishing output, however depending, inter alia, on the pressure of extinguishing medium in the inlet 15 of the spraying head.

Figure 5:
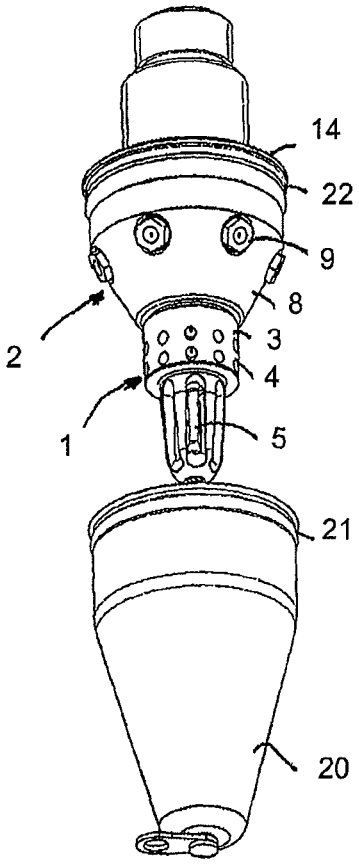
FIG. 5 shows another spraying head according to an embodiment of the invention with a protective element in a second position.
Figure 4:
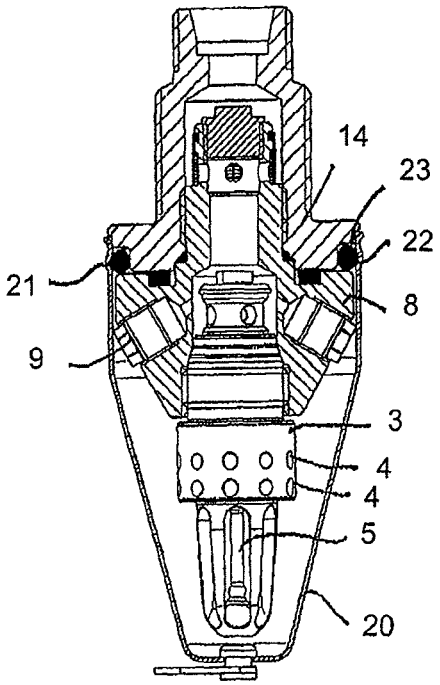
FIG. 4 shows another partly cut spraying head according to an advantageous embodiment of the invention.

FIGS. 4 and 5 show another advantageous embodiment of a spraying head according to the invention in which the spraying head is in the non-active mode provided with a protective element 20. The protective element 20 is in a protective position in front of the nozzle 4, 9 and mechanically protects the triggering element 5 when the sprinkler is in the non-active mode, and which protective element 20 is movable to a second position in which the nozzles 4, 9 and the triggering means 5 are not protected by the protective element 20. In the embodiment according to the figures, a force effect is directed at the protective element 20 by pressure medium from the effect of which the protective element 20 moves from the first position to the second position. The force effect is provided with pressure medium sprayed from the nozzles 9 which medium is advantageously extinguishing medium in an embodiment.

The spraying head thus comprises the cup-like protective element 20 which protects the triggering means 5 and the nozzles 4, 9. The protective element 20 is fastened in the arrangement according to FIG. 4 by means of a sealing element 22, most suitably an annular seal, in the protective position. To the protective part 20 is formed a groove 21 for the annular seal 22. The groove 21 and the annular seal 22 of the protective part form a locking which keeps the protective part in its place in the protective position. Because of the ring seal 22, the protective element keeps well in its place in the protective position, whereby the vital parts of the sprinkler are well protected from the effects of the sprinkler surroundings. Such parts intended for protection are, inter alia, the triggering means 5, typically an ampoule, and the nozzles 4, 9. The spraying head can be placed in very different environments where it is exposed to impurities and dirtying which might impede the functioning of the sprinkler, inter alia, to cause malfunctions of the sprinkler without the protective element 20. On the other hand, a spraying head provided with a protective element can be installed on sites having high hygiene requirements.

Furthermore, the protective element 20 prevents the unwanted triggering of the triggering means 5 e.g. as a result of a short hot gas flow directed at the sprinkler.

Figure 6:
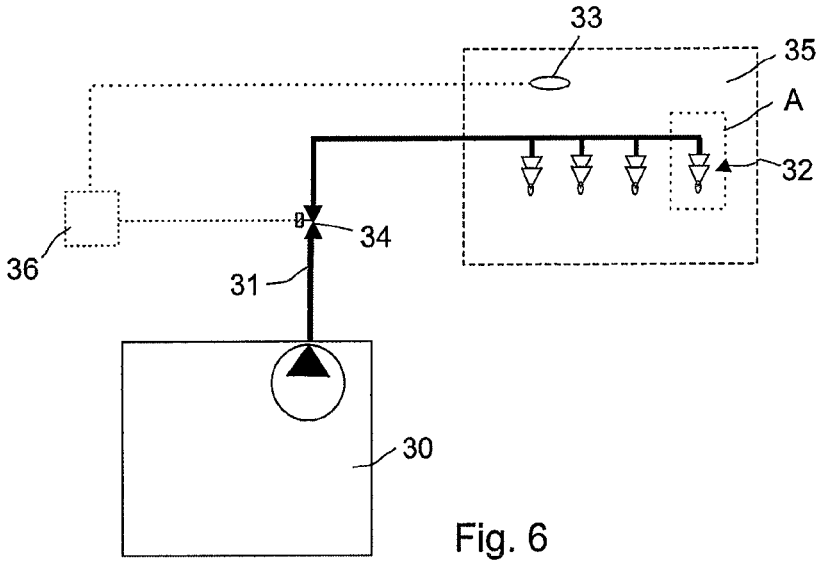
FIG. 6 shows a simplified schematic diagram of an extinguishing system applying the invention.
Figure 6A:
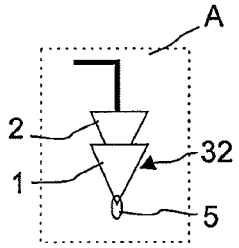
FIG. 6*a* shows a detail A of FIG. 6.

FIG. 6 shows a simplified fire-extinguishing system applying the invention. FIG. 6*a* shows a detail of FIG. 6. An extinguishing medium source 30 is shown as a box chart whereby it is considered to comprise also required pressure arrangements, such as pressure means, a pump device or their combination, for conveying extinguishing medium into a piping 31 which leads to spraying heads 32 arranged on a protected target site 35. On the target site in the embodiment according to the figure is arranged a detector device 33, such as a detector reacting to smoke, heat or other observable indication. The detector 33 is connected directly or by means of a control system 36 to a valve element 34 which opens an access to the extinguishing medium to the spraying heads 32 based on a signal from the detector 33. At this first stage, only the first nozzles of the always open spraying head part 2 of the spraying heads 32 start to spray extinguishing medium. The passage for the second nozzles of the sprinkler head 1 closed at the first stage of each spraying head 32 does not open until the spraying-head-specific triggering means 5 has triggered and the valve element or equivalent closing the passage of medium has moved to a position in which the passage of medium is open for the other nozzles.

Thus, the invention also relates to a spraying apparatus, especially a fire-extinguishing apparatus, which comprises a medium source 30, means 31 for conveying medium to be sprayed from the medium source to at least one spraying head and a detector device 33 based on the signal of which a valve element 34 is controlled which adjusts the access of medium from the medium source to the spraying head. The spraying head 32 was described in more detail above. The apparatus advantageously comprises several spraying heads 32.

The flow at the first stage of each spraying head through open nozzles is noticeably small compared with the flow at the second stage when also the second nozzles start to spray extinguishing medium. The flow volume of the spraying head can be calculated with the formula $Q=k\sqrt{p}$, in which Q is flow volume, p is pressure which presses medium through the nozzle and k is resistance caused by the nozzle. The sum of the k values of the nozzles at the first stage is e.g. less than 50%, advantageously less than 35%, most advantageously less than 10% from the sum of the k values of the whole nozzle head. At the first stage, pressure in the feed pipe at the point of the nozzle head is high, e.g. 100-200 bar, advantageously 120-160 bar. Then, medium mist to be sprayed provided at the first stage is extremely fine. This has been considered to enable the smothering of small fires even as such.

Fine mist sprayed at the first stage can be used for other applications than fire extinguishing, such as e.g. for pure cooling or pure moistening. Then, the detector 33 on the target site 35 can react e.g. to temperature, air humidity or some other suitable indication. The system can thus be used for combining a cooling system and a fire extinguishing system. The first stage would then mainly function for the cooling and/or moistening purpose and the second stage functioning spraying-head-specifically mainly for the fire extinguishing purpose.

According to an embodiment of the invention, the spraying head is a combination of the sprinkler head 1 and the spraying head 2. According to an advantageous embodiment of the invention, the sprinkler head 1 and the spraying head 2 are modules which can be joined and thus they together form a combined spraying head according to the invention. It can also be considered that the spraying head frame 8 and the sprinkler frame 3 are of one piece.

According to an embodiment of the invention, the invention relates to a spraying head, especially a spraying head intended for fire extinguishing, which comprises a frame part, an inlet for extinguishing medium and at least two nozzles. At least one first nozzle 9 is arranged in the spraying head part 2, for which first nozzle 9 the medium passage from the inlet of the spraying head is always open and that at least one second nozzle 4 is arranged in the sprinkler part 1 which comprises a triggering means 5, whereby the passage of medium from the inlet to at least one second nozzle 4 is closed when the triggering means 5 is non-activated, and that the passage of medium for at least one second nozzle 4 is open when the triggering means 5 is activated. The triggering means 5, such as an ampoule or equivalent, is non-activated when it is in one piece in its place according to an embodiment.

In the embodiments of the figures, the spraying head part 2 and the sprinkler part 1 are of different pieces. However, it can be alternatively considered that the spraying head part 2 and the sprinkler part 1 were of the same piece.

According to another embodiment, the spraying head comprises a protective element 20 which is in a protective position in front of the nozzle 4, 9 and mechanically protects the triggering means 5 when the spraying head is in the non-active mode, and which protective element 20 is movable to a second position in which at least one nozzle 4, 9 and the triggering means 5 are not protected by the protective element 20.

In the embodiment of the figures, the sprinkler part 1 is releasably fastened to the spraying head part 2. Then, it is possible to replace only the sprinkler part, if required. The spraying head part 2 and the sprinkler part 1 form a spraying head combination. Thus, it is possible to use combinations comprising a spraying head 2 and a sprinkler head 1 having different characteristics.

The spraying head part 2 comprises a spraying head frame 8 which has a conical surface on which the first nozzles 9 are arranged.

The open spraying head part 2 of the spraying head is, when activated, arranged to spray aqueous extinguishing medium or a mixture of aqueous extinguishing medium and gas. The sprinkler part 1 of the spraying head is, when activated, arranged to spray aqueous extinguishing medium mist or a mixture of aqueous extinguishing medium mist and gas.

In the method according to the invention for fire extinguishing, based on a signal from the detector 33 is opened a passage for extinguishing medium from the extinguishing medium source 30 for at least one spraying head 32 installed on the protected site 35 and extinguishing medium is conveyed from the extinguishing medium source along the pipeline 31 to at least one spraying head installed in the protected site. The diagrams of FIGS. 6 and 6*a* show a simplified system applying the method according to the invention. The passage is opened according to an advantageous embodiment with the valve element 34. In the method at the first stage, extinguishing medium is sprayed by at least one first nozzle 9 of at least one nozzle head 32 of the activated site 35 (FIG. 2) and, at the second stage, additionally by at least one second nozzle 4 activated nozzle-head-specifically, opened due to the triggering of the triggering means 5.

At the first stage, the volume of extinguishing medium flowing through at least one nozzle 9 of the nozzle head is typically smaller compared with the volume of extinguishing medium flowing through the nozzles 4, 9 of the nozzle head at the second stage.

In the embodiment of the invention, at the first stage is sprayed medium mist. Typically, also at the second stage is sprayed medium mist.

The medium mist sprayed at the first stage can be used for cooling and/or moistening the target site.

Typically, the medium mist sprayed at the first stage is used for protecting the target site from fire. Then, it can be used e.g. for smothering small fires.

The medium mist sprayed at the second stage is used for fire extinguishing. Because the flow volume of the spayed extinguishing medium is for the activated spraying head considerably larger than at the first stage, an extremely efficient extinguishing effect is directed at the vicinity of the fire site.

According to an embodiment of the invention (FIGS. 4 and 5), the spraying head comprises the protective element 20 which is in the protective position in front of the nozzle 4, 9 and mechanically protects the triggering means 5 when the spraying head is in the non-active mode, and which protective element 20 is moved to the second position in which at least one nozzle 4, 9 and the triggering means 5 are not protected by the protective element 20.

The protective element 20 is moved to the second position by spraying extinguishing medium at the first stage by at least one first nozzle 9.

Aqueous liquid and/or a mixture of aqueous liquid and gas is typically used as the medium. With the spraying heads, extinguishing medium mist, especially water mist, is sprayed. Typically, the drop size (Dv 90) of extinguishing medium mist is less than 200 micrometers. The extinguishing medium is sprayed with high pressure, advantageously 10-300 bar.

It is obvious to those skilled in the art that the invention is not limited to the embodiments described above, but it may be varied within the scope of the enclosed claims. When necessary, the features possibly described in this specification together with other features may also be used separately from each other.

The invention claimed is:

1. A spraying head for fire extinguishing comprising:

a frame part defining an inlet for extinguishing medium;

a spraying head part coupled with the frame part and at least partially defining a first passage in fluid communication with the inlet;

wherein the first passage is configured to fluidly couple to a valve element, the valve element is configured to receive a signal from a detector device so as to provide a medium from a medium source to the spraying head;

a first nozzle arranged in the spraying head part, wherein the first nozzle is in communication with the inlet via the first passage,the first passage being an open passage from an outlet of the first nozzle to the valve element, the valve element located upstream of the inlet;

a sprinkler part coupled with the spraying head part, comprising a heat-sensitive trigger, and defining a second passage fluidly communicating with the inlet; and a second nozzle arranged in the sprinkler part and in fluid communication with the inlet via the second passage, wherein the second passage is closed when the trigger is non-activated, and the second passage is open when the trigger is activated, wherein the trigger is a one-time trigger that breaks once activated leaving the second passage an open passage.

2. A spraying head according to claim 1, wherein the spraying head part and the sprinkler part are different pieces.

3. A spraying head according to claim 1, wherein the spraying head part and the sprinkler part are integrally formed.

4. A spraying head according to claim 1, wherein the spraying head comprises a protective element which, in a protective position, is in front of the first and second nozzles and mechanically protects the trigger when the spraying head is in the non-active mode, wherein the protective element is movable to a second position in which the first and second nozzles and the trigger are not protected by the protective element.

5. A spraying head according to claim 1, wherein the sprinkler part is releasably fastened to the spraying head part.

6. A spraying head according to claim 1, wherein the spraying head part and the sprinkler part form a spraying head combination.

7. A spraying head according to claim 1, wherein the spraying head part comprises a spraying head frame having a conical surface on which the first nozzle is arranged.

8. A spraying head according to claim 1, wherein the spraying head part is arranged, when activated, to spray aqueous extinguishing medium or a mixture of aqueous extinguishing medium and gas.

9. A spraying head according to claim 1, wherein the sprinkler part of the spraying head is arranged, when activated, to spray aqueous extinguishing medium mist or a mixture of aqueous extinguishing medium mist and gas.

10. A method for fire extinguishing, comprising:

receiving a signal from a detector; and opening a passage for extinguishing medium from an extinguishing medium source to at least one spraying head located at a protected site, wherein the extinguishing medium is conveyed from the extinguishing source along a pipeline to the at least one spraying head, wherein the at least one spraying head is a spraying head according to claim 1.

11. A method according to claim 10, wherein, at the first stage, a volumetric flow rate of extinguishing medium flowing through the spraying head during the first stage is less than a volumetric flow rate of the extinguishing medium flowing through the spraying head during the second stage.

12. A method according to claim 10, wherein during the first stage, the extinguishing medium is sprayed in a mist.

13. A method according to claim 10, wherein, during the second stage, the extinguishing medium is sprayed in a mist.

14. A method according to claim 10, wherein the extinguishing medium sprayed during the first stage is used for cooling and/or moistening the protected site.

15. A method according to claim 10, wherein the medium mist sprayed at the first stage is used for protecting the protected site from fire.

16. A method according to claim 10, wherein the extinguishing medium sprayed at the second stage is used for fire extinguishing.

17. A method according to claim 10, wherein the spraying head comprises a protective element that, in a protective position, is in front of the first and second nozzles, and mechanically protects the trigger when the spraying head is in a non-active mode, and wherein the protective element is moved to a second position in which first and second nozzles and the trigger are not protected by the protective element.

18. A method according to claim 17, wherein the protective element is moved to the second position by spraying extinguishing medium through the first nozzle during the first stage.

19. A system for fire-extinguishing comprising:

a medium source;

means for conveying medium to be sprayed from the medium source to a spraying head and;

wherein the spraying head is a spraying head according to claim 1.

20. A system according to claim 19, further comprising a plurality of spraying heads including the spraying head.

* * * * *